US009184012B2

(12) United States Patent
Wang

(10) Patent No.: US 9,184,012 B2
(45) Date of Patent: Nov. 10, 2015

(54) INTEGRATED CIRCUIT FUSE AND METHOD OF FABRICATING THE INTEGRATED CIRCUIT FUSE

(71) Applicant: Yigong Wang, Rutland, MA (US)

(72) Inventor: Yigong Wang, Rutland, MA (US)

(73) Assignee: Allegro Microsystems, LLC, Worcester, MA (US)

( * ) Notice: Subject to any disclaimer, the term of this patent is extended or adjusted under 35 U.S.C. 154(b) by 0 days.

(21) Appl. No.: 13/720,098

(22) Filed: Dec. 19, 2012

(65) Prior Publication Data

US 2014/0167906 A1 Jun. 19, 2014

(51) Int. Cl.

| | |
|---|---|
| ***H01H 85/48*** | (2006.01) |
| ***H01H 69/02*** | (2006.01) |
| ***H01H 85/00*** | (2006.01) |
| *H01H 85/041* | (2006.01) |
| *H01H 85/46* | (2006.01) |

(52) U.S. Cl.

CPC ..... *H01H 69/022* (2013.01); *H01H 85/0047* (2013.01); *H01H 2085/0414* (2013.01); *H01H 2085/466* (2013.01); *Y10T 29/49107* (2015.01)

(58) Field of Classification Search

CPC ..... H01H 69/022

See application file for complete search history.

(56) References Cited

U.S. PATENT DOCUMENTS

| | | | | |
|---|---|---|---|---|
| 2007/0003713 | A1 | 1/2007 | Wexler et al. | |
| 2008/0100411 | A1 * | 5/2008 | Tofigh et al. | 337/163 |
| 2008/0218305 | A1 * | 9/2008 | Bender et al. | 337/297 |

FOREIGN PATENT DOCUMENTS

WO WO 91/12706 A1 8/1991

OTHER PUBLICATIONS

Taiwanese Office Action dated Mar. 25, 2015; for Taiwan Pat. App. No. 102142477 8 pages.

Letter to Taiwan International Patent & Law Office dated May 13 2015: for Taiwan Pat. App. No. 102142477; 14 pages.

Email from Taiwan International Patent & Law Office dated Jun. 23, 2015; for Taiwan Pat. App. No. 102142477; 2 pages.

Taiwan Response (incuding Claims in English) filed Jun. 23, 2015; for Taiwan Pat. App. No. 102142477; 9 pages.

* cited by examiner

*Primary Examiner* — Fernando L Toledo
*Assistant Examiner* — Valerie N Newton
(74) *Attorney, Agent, or Firm* — Daly, Crowley, Mofford & Durkee, LLP

(57) ABSTRACT

A fuse formed as part of an integrated circuit has cavities disposed to the sides of the fuse to provide more reliable operation with less chance of re-connection. A method of providing the fuse is also described.

24 Claims, 4 Drawing Sheets

INTEGRATED CIRCUIT FUSE AND METHOD OF FABRICATING THE INTEGRATED CIRCUIT FUSE

CROSS REFERENCE TO RELATED APPLICATIONS

Not Applicable.

STATEMENT REGARDING FEDERALLY SPONSORED RESEARCH

Not Applicable.

FIELD OF THE INVENTION

This invention relates generally to fuses used in integrated circuits, and, more particularly, to an integrated circuit fuse that blows more reliably and with less chance of re-connection.

BACKGROUND OF THE INVENTION

Fuses used in integrated circuits are known. Some conventional integrated fuses use a conductor within a metal layer of an integrated circuit.

Conventional integrated circuit fuses are subject to a variety of types of failure. In one type of failure, cracks in and an interlayer dielectric (ILD) structure, for example, the ILD isolation between metal layers in which the integrated circuit fuse is formed, sometimes fractures when the integrated circuit fuse is blown. Fracture/cracking of the ILD is very undesirable and leads to shorts and unwanted leakage in the overall integrated circuit.

In another type of failure, when an integrated circuit fuse is fused, debris from the fusing sometimes remains in electrical contact with the fused portion of the fuse, and the fuse is not fully blown. This type of failure is sometimes referred to as regrowth or reconnection of the fuse.

It would be desirable to provide an integrated circuit fuse that has reduced failure characteristics, for example, a reduced likelihood that fusing of the integrated, circuit fuse causes fracture of an interlayer dielectric (ILD) structure, and a reduced likelihood that fusing of the integrated circuit fuse results in regrowth of the fuse.

SUMMARY OF THE INVENTION

The present invention provides an integrated circuit fuse that has reduced failure characteristics, for example, a reduced likelihood that fusing of the integrated circuit fuse causes fracture of an interlayer dielectric (ILD) structure, and a reduced likelihood that fusing of the integrated circuit fuse results in regrowth of the fuse.

In accordance with one aspect of the present invention, a fuse disposed over a substrate of an integrated circuit includes a conductive trace in a fuse-level metal layer of the integrated circuit, wherein the conductive trace comprises a fusible portion having a higher resistance than other portions of the conductive trace. The fuse further includes a dielectric structure disposed over the fusible portion and beyond the fusible portion in a direction parallel to a major surface of the substrate. The fuse further includes a first cavity into the dielectric structure. The first cavity is proximate to the fusible portion and separated from the fusible portion by a first separation wall. The first cavity has a depth to at least a depth of the fuse-level metal layer with a deeper direction being in a direction of the substrate. The entire first cavity is disposed to a first side of the fusible portion in a direction parallel to a major surface of the substrate such that no part of the first cavity is over the fusible portion. The first separation wall has a thickness selected to result in fracture of the first separation wall and capture of debris from the fusible portion when the fusible portion is fused.

In accordance with another aspect of the present invention, a method of fabricating a fuse over a substrate of an integrated circuit includes forming a conductive trace in a fuse-level metal layer of the integrated circuit, wherein the fuse-level metal layer is disposed over a substrate of the integrated circuit, and wherein the conductive trace comprises a fusible portion having a higher resistance than other portions of the conductive trace. The method also includes forming a dielectric structure over the fusible portion and beyond the fusible portion in a direction parallel to a major surface of the substrate. The method also includes etching a first cavity into the dielectric structure. The first cavity is proximate to the fusible portion and separated from the fusible portion by a first separation wall. The first cavity has a depth to at least a depth of the fuse-level metal layer with a deeper direction being in a direction of the substrate. The entire first cavity is disposed to a first side of the fusible portion in a direction parallel to a major surface of the substrate such that no part of the first cavity is over the fusible portion. The first separation wall has a thickness selected to result in fracture of the first separation wall and capture of debris from the fusible portion when the fusible portion is fused

BRIEF DESCRIPTION OF THE DRAWINGS

The foregoing features of the invention, as well as the invention itself may be more fully understood from the following detailed description of the drawings, in which.

DETAILED DESCRIPTION OF THE INVENTION

Before describing the present invention, it should be noted that reference is sometimes made herein to integrated fuse assemblies having features with sizes and with particular shapes (e.g., rectangular). One of ordinary skill in the art will appreciate, however, that the techniques described herein are applicable to a variety of sizes and shapes.

Figure 1:
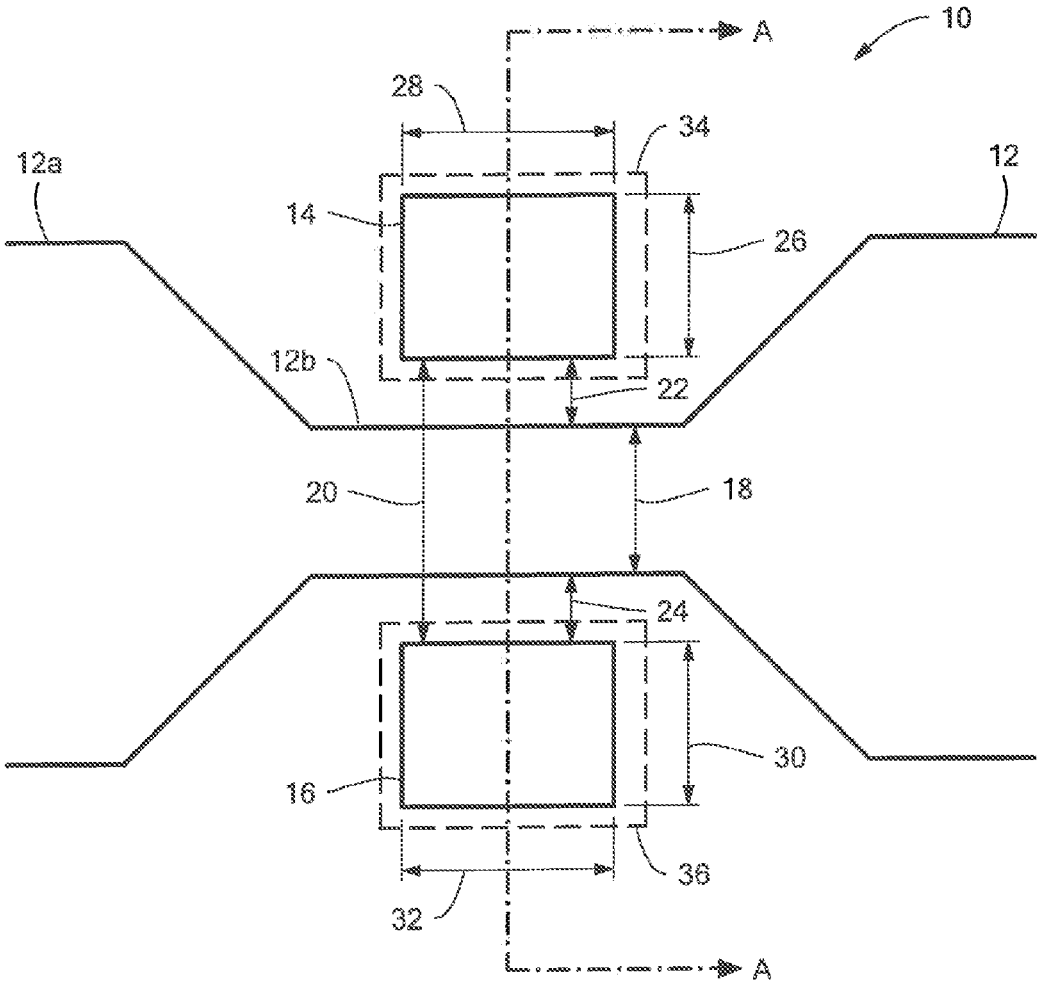
FIG. 1 is a pictorial showing a top view of a fuse structure used in integrated circuit and having a fusible portion and at least one cavity proximate to and to the side of the fusible portion.

Referring to FIG. 1, a fuse structure 10 can be formed over a substrate of an integrated circuit, and, in particular, within a metal layer of the integrated circuit. The fuse structure 10 can include a fuse conductor 12 having a wide portion 12*a* and a narrower portion 12*b*, also referred to herein as fusible portion 12*b*. The fusible portion 12*b* has a size, shape, and resistance selected to result in breaking, i.e., fusing, of the fusible portion 12*b* upon application of an electrical current greater than or equal to a fusing current through the fuse conductor 12.

The fuse structure 10 can also include at least one cavity, e.g., a cavity 14 disposed to the side of the fusible portion 12*b*. The cavity 14 has a spacing 22 from the fusible portion 12*b* and the cavity 14 also has a size, shape, and depth all selected to capture debris from the fusible portion 12*b* when the fusible portion 12*b* is fused.

In some embodiments, the fuse structure 10 includes a second cavity 16, which, in some embodiments, can have a spacing 24 from the fusible portion 12*b* and the cavity 16 also a size, shape, and depth all selected to capture debris from the fusible portion 12*b* when the fusible portion 12*b* is fused. However, it will be understood that, when the fusible portion 12*b* is fused, most or all of the debris from the fusing will tend to move into one of the two cavities 14, 16. The spacing 24 can be the same as or similar to the spacing 22.

The cavities 14, 16 extend in a direction into the page, to depths that will be apparent from the discussion below in conjunction with FIGS. 2-7.

In some embodiments, the fusing operation is used in an integrated circuit to provide a permanent change of state, for example, a high voltage to a low voltage, or a low-voltage to a high voltage, upon one side of the fuse structure 12. In some embodiments, the fuse structure 10 is one of a plurality of such fuse structures used in a programmable read-only memory (PROM).

The cavity 14 can have a width 26 and in length 28. The cavity 16 can have a width 30 and a length 32, which can be the same as or similar to the width 26 and length 28 of the cavity 14.

Under the cavity 14 is shown a so-called "blanket" 34. The blanket 34 can be comprised of a portion of a metal layer. Similarly, under the cavity 16 is shown another blanket 36. It will become apparent from discussion below in conjunction with FIGS. 2-7 that the blankets 34, 36 can be on the same metal layer as the fuse conductor 12, or the blankets 34, 36 can be on a different layer than the fuse conductor 12.

In one exemplary embodiment, the dimension 18 is about 1.0 micrometers, the dimensions 22, 24 are about 1.2 micrometers, the dimensions 28, 32 are about 6.0 micrometers, the dimensions 26, 30 are about 4.0 micrometers, and the dimension 20 is about 3.4 micrometers.

However, in other embodiments, the dimension 18 is in r range of about 0.5 to about 1.5 micrometers, the dimensions 22, 24 are in a range of about 1.0 to about 1.5 micrometers, the dimensions 28, 32 are in a range of about 3.0 to about 12.0 micrometers, the dimensions 26, 30 are in a range of about 3.0 to about 10.0 micrometers, and the dimension 20 is in a range of about 2.0 to about 5.0 micrometers.

In some embodiments, the blankets 34, 36 are larger than the cavities 14, 16 by about 0.25 micrometers in all directions in the plane shown. However, in other embodiments, the blankets 34, 36 can be within a range of about 0.1 to about 0.5 micrometers larger than the cavities 14, 60.

It will be understood that some dimensions, in particular, the dimensions 22, 24, are particularly important for proper operation of the fuse structure 10. It will be understood that regions represented by the dimensions 22, 24 either must be open or must open, i.e., break open, when the fusible portion 12*b* fuses. Furthermore, no fracture of the underlying substrate must occur.

Referring to FIGS. 2-7, in each of which like elements of FIG. 1 are shown having like reference designations, a variety of exemplary embodiments of the integrated circuit fuse structure 10 of FIG. 1 are shown. The embodiments of FIGS. 2-7 presume that there are three metal layers in associated integrated circuits. However, in other embodiments, there can be more than three or fewer than three metal layers. The three metal layers are used to show an integrated circuit fuse formed on a middle metal layer, on an outermost or metal layer, and on an innermost or bottom metal layer. It will be understood from discussion below that fuses formed on the top or bottom metal layers are less desirable than fuses formed in middle metal layers of the integrated circuit, for example, in the metal two layer of a three metal layer integrated circuit or on a metal two or metal three layer of a four metal layer integrated circuit. However, fuses formed on the top metal layer or on the bottom metal layer are possible.

In each of FIGS. 2-7, metal is shown as crosshatched regions. Metal can be substantially cleared away on other metal layers apart from the metal shown. Such clearing of the metal on other metal layers reduces a likelihood that fusing of the fusible portion 12*b* and debris caused therefrom will result in an unwanted conduction to another metal layer. However, while not shown, in other regions of metal layers, including a fuse-level metal layer, there can be other conductors used for interconnections within the integrated circuits.

In each of FIGS. 2-7, layer identifiers are shown as rectangles on each side of the figures. In general, both active semiconductor structures and metal layers can be spaced away from the fusible portions 12*b* and cavities 14, 16 of FIGS. 1-7, in which case, the fusible portions 12*b* and cavities 14, 16 can be surrounded by interlayer dielectric (ILD). The ILD can be formed in a plurality steps, i.e., progressively grown, for example, as other ones of the layers are deposited or grown. The ILD can be comprised of a variety of materials, including, but not limited to silicon dioxide, nitride, and a polymer, for example, polymide.

Figure 2:
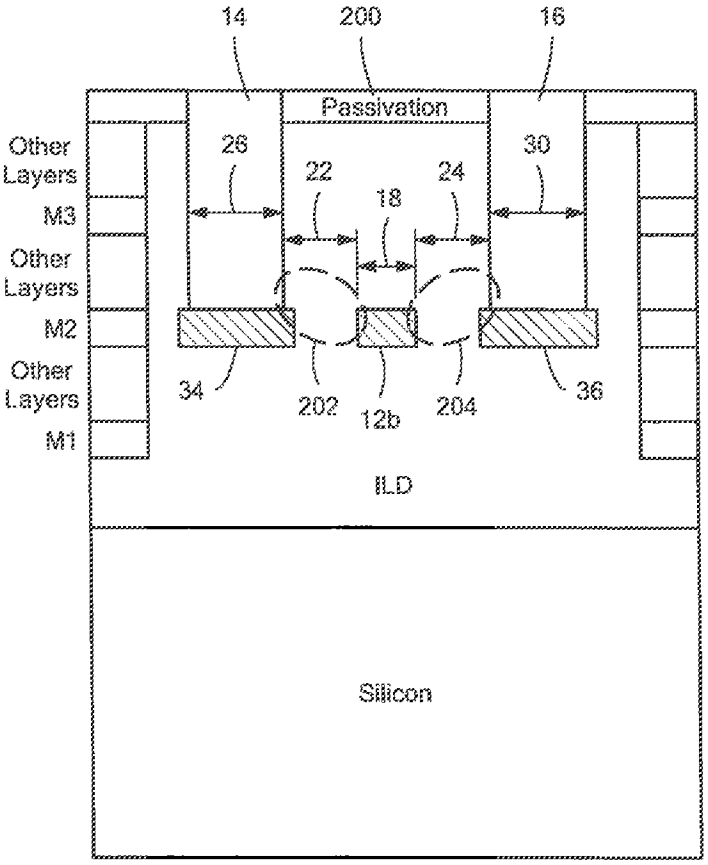
FIG. 2 is a block diagram showing a side view of an exemplary embodiment of the fuse structure of FIG. 1.

Referring now to FIG. 2, an exemplary embodiment of the fuse structure 10 of FIG. 1 is shown in an integrated circuit structure 200. The integrated circuit structure 200 is shown to include three metal layers, M1, M2, M3. However, it should be recognized that integrated circuits can have more than three or fewer than three metal layers.

Other layers are also shown, which can be any variety of active or passive layers.

The fusible portion 12*b* of the fuse conductor 12 is shown on the same metal layer M2 as the blankets 34, 36. The cavities 14, 16 extend from an outer surface, i.e., above a passivation layer, and past various layers, including other metal layers, of the integrated circuit structure 200. The cavities 14, 16 extend to and are essentially capped by or terminated by the blankets 34, 36. The blankets 34, 36 are comprised of metal in the same metal layer the same as the fusible portion 12*b* and can be fabricated in the same fabrication step as the fusible portion 12*b*.

An interlayer dielectric (ILD) surrounds the fusible portion 12*b*, the blankets 34, 36, and the cavities 14, 16, and the cavities 14, 16 extend into the ILD. As described above, the ILD can be formed in a plurality of fabrication steps. The ILD is referred to herein as a dielectric structure.

With proper selection of dimensions, upon fusing of the fusible portion 12*b*, debris from the fusible portion 12*b* will fracture the ILD in at least one of regions 202, 204 (i.e., separation walls) between the fusible portion 12*b* and the cavities 14, 16, and the debris will move through a respective at least one of the regions 202, 204, becoming captured in a respective at least one of the cavities 14, 16. The ILD layer must yield in at least one of the regions 202, 204 before more extensive damage to the integrated circuit ensues, including, but not limited to, fracture of the ILD in other regions.

Figure 3:
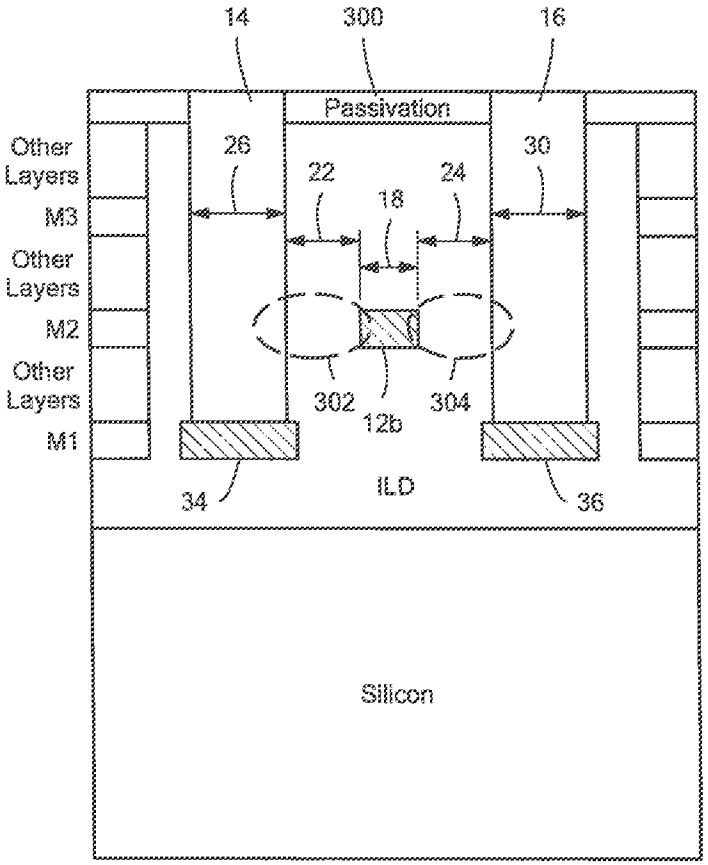
FIG. 3 is a block diagram showing a side view of another exemplary embodiment of the fuse structure of FIG. 1.

Referring now to FIG. 3, another exemplary embodiment of the fuse structure 10 of FIG. 1 is shown in an integrated circuit structure 300. The integrated circuit structure 300 is shown to include three metal layers, M1, M2, M3. However, it should be recognized that integrated circuits can have more than or fewer than three metal layers.

Other layers are also shown, which can be any variety of active or passive layers.

The fusible portion 12*b* of the fuse conductor 12 is shown on the metal layer M2 and the blankets 34, 36 are shown on the metal layer M1. The cavities 14, 16 extend from an outer surface, i.e., above a passivation layer, and past various layers, including other metal layers, of the integrated circuit structure 300. The cavities 14, 16 extend to and are essentially capped by or terminated by the blankets 34, 36. The blankets 34, 36 are comprised of metal on a metal layer different than the fusible portion 12*b*, and thus, are fabricated in a different fabrication step then the fusible portion 12*b*.

Interlayer dielectric (ILD) surrounds the fusible portion 12*b*, the blankets 34, 36, and the cavities 14, 16, and the cavities 14, 16 extend into the ILD structure.

With proper selection of dimension, upon fusing of the fusible portion 12*b*, debris from the fusible portion 12*b* will fracture the ILD in at least one of regions 302, 304 (i.e., separation walls) between the fusible portion 12*b* and the cavities 14, 16, and the debris move through a respective at least one of the regions 302, 304, becoming captured in a respective at least one of the cavities 14, 16. The ILD layer must yield in at least one of the regions 302, 304 before more extensive damage to the integrated ensues, including, but not limited to, fracture of the ILD in other regions.

Figure 4:
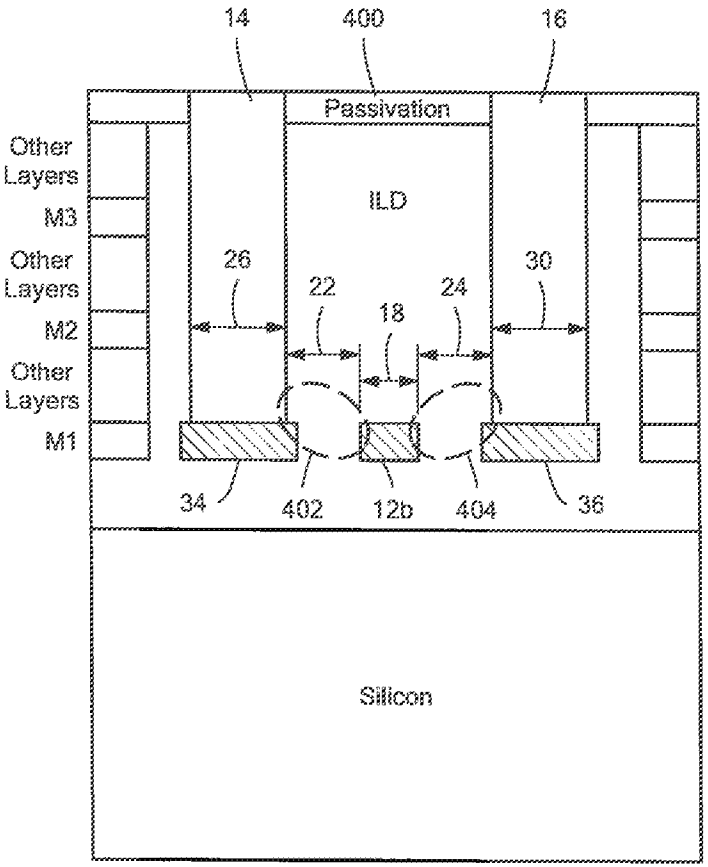
FIG. 4 is a block diagram showing a side view of another exemplary embodiment of the fuse structure of FIG. 1.

Referring now to FIG. 4, another exemplary embodiment of the fuse structure 10 of FIG. 1 is shown in an integrated circuit structure 400. The integrated circuit structure 400 is shown to include three metal layers, M1, M2, M3. However, it should be recognized that integrated circuits can have more than or fewer than three metal layers.

Other layers are also shown, which can be any variety of active or passive layers.

The fusible portion 12*b* of the fuse conductor 12 is shown on the metal layer M1 and the blankets 34, 36 are also shown on the metal layer M1. The cavities 14, 16 extend from an outer surface, i.e., above a passivation layer, and past various layers, including other metal layers, of the integrated circuit structure 400. The cavities 14, 16 extend to and are essentially capped by or terminated by the blankets 34, 36. The blankets 34, 36 are comprised of metal in the same metal layer the same as the fusible portion 12*b* and can be fabricated in the same fabrication step as the fusible portion 12*b*.

An interlayer dielectric (ILD) surrounds the fusible portion 12*b*, the blankets 34, 36, and the cavities 14, 16, and the cavities 14, 16 extend into the ILD structure.

Regions 402, 404 will be understood from the above discussion of regions 202, 204 of FIG. 2.

As described above, this not a particularly desirable arrangement, but it is possible. The fusible portion 12*b* is close to the substrate and could result in fracture of the substrate.

Figure 5:
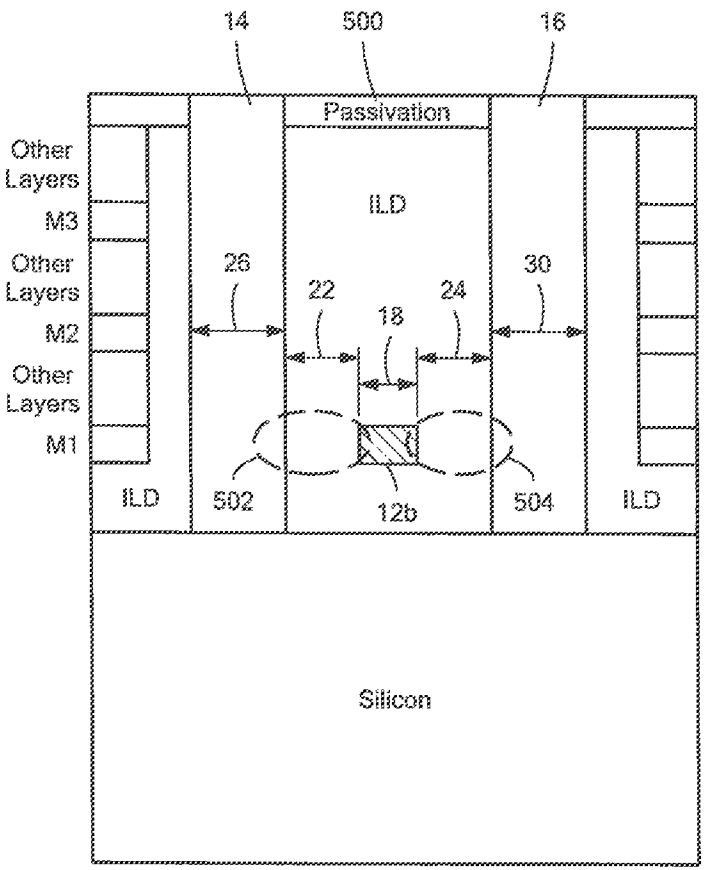
FIG. 5 is a block diagram showing a side view of another exemplary embodiment of the fuse structure of FIG. 1.

Referring now to FIG. 5, another exemplary embodiment of the fuse structure 10 of FIG. 1 is shown in an integrated circuit structure 500. The integrated circuit structure 500 is shown to include three metal layers, M1, M2, M3. However, it should be recognized that integrated circuits can have more than or fewer than three metal layers.

Other layers are also shown, which can be any variety of active or passive layers.

The fusible portion 12*b* of the fuse conductor 12 is shown on the metal layer M1 and the integrated circuit structure 500 has no blankets. The cavities 14, 16 extend from an outer surface, i.e., above a passivation layer, and past various layers, including other metal layers, of the integrated circuit structure 500. The cavities 14, 16 extend to and are essentially capped by or terminated by the silicon substrate. There are no metal blankets.

An interlayer dielectric (ILD) surrounds the fusible portion 12*b* and the cavities 14, 16, and the cavities 14, 16 extend into the ILD structure.

Regions 502, 504 will be understood from the above discussion of regions 202, 204 of FIG. 2.

As described above, this not a particularly desirable arrangement, but it is possible. The fusible portion 12*b* is close to the substrate and could result in fracture of the substrate, particularly where no blankets are used.

Figure 6:
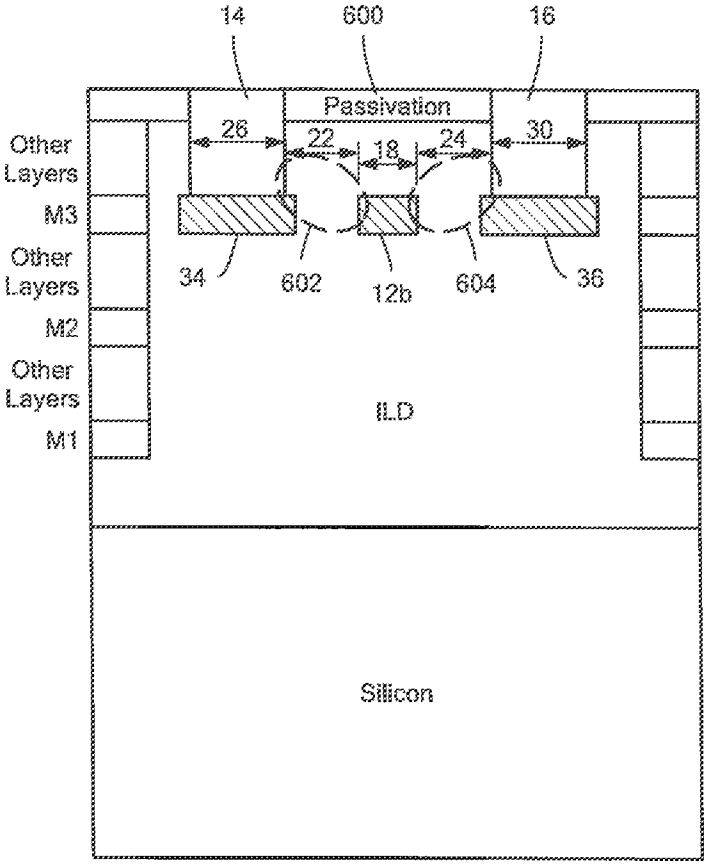
FIG. 6 is a block diagram showing a side view of another exemplary embodiment of the fuse structure of FIG. 1.

Referring now to FIG. 6, another exemplary embodiment of the fuse structure 10 of FIG. 1 is shown in an integrated circuit structure 600. The integrated circuit structure 500 is shown to include three metal layers, M1, M2, M3. However, it should be recognized that integrated circuits can have more than or fewer than three metal layers.

Other layers are also shown, which can be any variety of active or passive layers.

The fusible portion 12*b* of the fuse conductor 12 is shown on the top metal layer M3 and the blankets 34, 36 are also shown on the metal layer M1. The cavities 14, 16 extend from an outer surface, i.e., above a passivation layer, and past various layers of the integrated circuit structure 500. The cavities 14, 16 extend to and are essentially capped by or terminated by the blankets 34, 36. The blankets 34, 36 are comprised of metal in the same metal layer the same as the fusible portion 12*b* and can be fabricated in the same fabrication step as the fusible portion 12*b*.

An interlayer dielectric (ILD) surrounds the fusible portion 12*b*, the blankets 34, 36, and the cavities 14, 16, and the cavities 14, 16 extend into the ILD structure.

Regions 602, 604 will be understood from the above discussion of regions 202, 204 of FIG. 2.

As described above, this not a particularly desirable arrangement, but it is possible. In general, a top metal layer, of which the M3 layer is representative, is often thicker than other metal layers. Integrated circuit design rules can also require larger feature dimension in the top metal layer. Thus, the fusible portion 12*b*, if formed in a top metal layer, may be thicker and wider than desirable, and accordingly, may require a higher power to blow the fuse, possibly resulting in damage to the integrated circuit.

Figure 7:
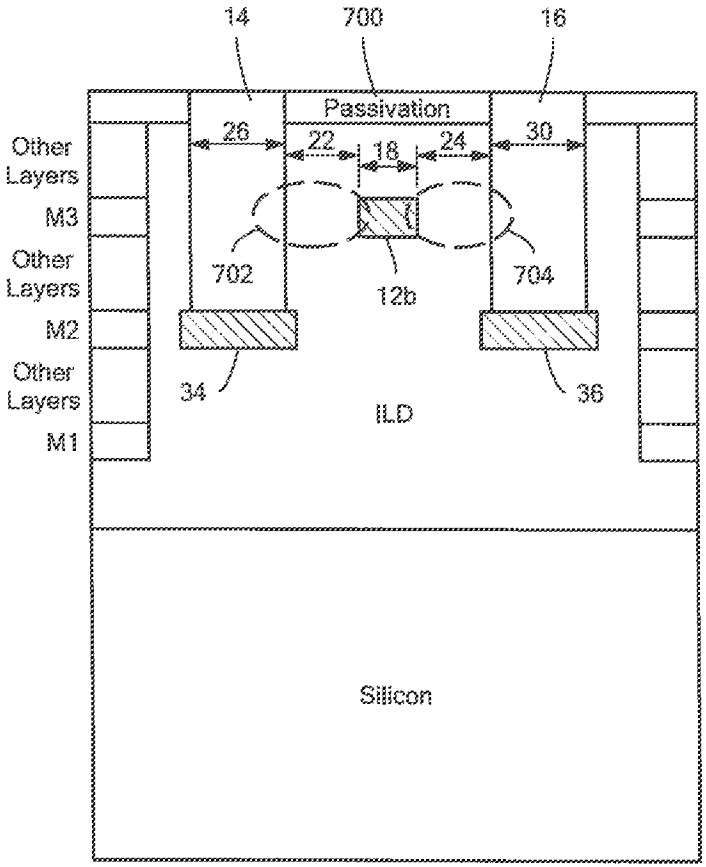
FIG. 7 is a block diagram showing a side view of another exemplary embodiment of the fuse structure of FIG. 1.

Referring now to FIG. 7, another exemplary embodiment of the fuse structure 10 of FIG. 1 is shown in an integrated circuit structure 700. The integrated circuit structure 500 is shown to include three metal layers, M1, M2, M3. However, it should be recognized that integrated circuits can have more than or fewer than three metal layers.

Other layers are also shown, which can be any variety of active or passive layers.

The fusible portion 12*b* of the fuse conductor 12 is shown on the top metal layer M3 and the blankets 34, 36 are also shown on the metal layer M2. The cavities 14, 16 extend from an outer surface, i.e., above a passivation layer, and past various layers of the integrated circuit structure 500 including other metal layers. The cavities 14, 16 extend to and are essentially capped by or terminated by the blankets 34, 36. The blankets 34, 36 are comprised of metal on a metal layer different than the fusible portion 12*b*, and thus, are fabricated in a different fabrication step then the fusible portion 12*b*.

While the cavities are shown to extend to blankets 34, 36 at the M2 layer, in other embodiments, the cavities could be deeper and extend to blankets at the M1 layer. In still other embodiments, the cavities could extend to the substrate and there would be no metal blankets.

An interlayer dielectric (ILD) surrounds the fusible portion 12*b*, the blankets 34, 36, and the cavities 14, 16, and the cavities 14, 16 extend into the ILD structure.

Regions 702, 704 will be understood from the above discussion of regions 202, 204 of FIG. 2.

As described above, this not a particularly desirable arrangement, but it is possible.

From discussion above, it should be understood that, for a semiconductor structure having any number of metal layers, the fusible portion 12*b* and the blankets can be at the same metal layer, or the metal blankets can be at any metal layer deeper than the fusible portion 12*b*. In some embodiments, the cavities extend all the way to the substrate.

All references cited herein are hereby incorporated herein by reference in their entirety.

Having described preferred embodiments of the invention, it will now become apparent to one of ordinary skill in the art that other embodiments incorporating their concepts may be used. It is felt therefore that these embodiments should not be limited to disclosed embodiments, but rather should be limited only by the spirit and scope of the appended claims.

What is claimed is:

1. A fuse disposed over a substrate of an integrated circuit, comprising:

a conductive trace in a fuse-level metal layer of the integrated circuit, wherein the conductive trace comprises a fusible portion having a higher resistance than other portions of the conductive trace, and wherein the fusible portion comprises a longest dimension;

a dielectric structure disposed over the fusible portion and beyond the fusible portion in a direction parallel to a major surface of the substrate; and a first cavity into the dielectric structure, the first cavity configured to capture debris from the fusible portion when the fusible portion is fused, wherein the first cavity is proximate to the fusible portion and separated from the fusible portion by a first separation wall, wherein the first cavity has a depth to at least a depth of the fuse-level metal layer with a deeper direction being in a direction toward the substrate, wherein the entire first cavity is disposed to a first side of the fusible portion in a direction parallel to a major surface of the substrate and perpendicular to the longest dimension of the fusible portion such that no part of the first cavity is over the fusible portion, wherein the first separation wall has a thickness selected to result in fracture, the fracture causing a fracture opening in the first separation wall and capture of debris from the fusible portion within the first cavity when the fusible portion is fused.

2. The fuse of claim 1, wherein the selected thickness of the first separation wall is within about +/− ten percent of 1.2 micrometers.

3. The fuse of claim 2, wherein the fusible portion has a width within about +/− ten percent of 1.0 micrometers.

4. The fuse of claim 1, wherein the first cavity extends to a depth at or below the fuse-level metal layer.

5. The fuse of claim 1, wherein the first cavity extends to the depth of the fuse-level metal layer, wherein the first cavity has a deepest end nearest to the substrate, and wherein the deepest end is bounded by a metal bounding portion of the fuse-level metal layer.

6. The fuse of claim 1, wherein the first cavity extends to a depth below the fuse-level metal layer, and wherein the first cavity has a deepest end nearest to the substrate, and wherein the deepest end is bounded by a metal bounding portion of another metal layer deeper than the fuse-level metal layer.

7. The fuse of claim 1, wherein the first cavity extends to a depth below the fuse-level metal layer, and wherein the first cavity has a deepest end nearest to the substrate, and wherein the deepest end is bounded by the substrate.

8. The fuse of claim 1, further comprising a second cavity into the dielectric structure, the second cavity configured to capture debris from the fusible portion when the fusible portion is fused, wherein the second cavity is proximate to the fusible portion and separated from the fusible portion by a second separation wall, wherein the second cavity has a depth to at least a depth of the fuse-level metal layer, wherein the entire second cavity is disposed to a second side of the fusible portion different than the first side in a direction parallel to the major surface of the substrate and perpendicular to the longest dimension of the fusible portion such that no part of the second cavity is over the fusible portion, wherein the first separation wall and the second separation wall have a thickness selected to result in fracture, the fracture causing a fracture opening in at least one of the first separation wall and the second separation wall and capture of debris from the fusible portion within at least one of the first cavity or the second cavity when the fusible portion is fused.

9. The fuse of claim 8, wherein the selected thickness of the first and second separation walls is within about +/− ten percent of 1.2 micrometers.

10. The fuse of claim 8, wherein the first and second cavities extend to the depth of the fuse-level metal layer, wherein the first and second cavities have respective deepest ends nearest to the substrate, and wherein the deepest ends are bounded by respective bounding metal portions of the fuse-level metal layer.

11. The fuse of claim 8, wherein the first and second cavities extend to the depth below the fuse-level metal layer, wherein the first and second cavities have respective deepest ends nearest to the substrate, and wherein the deepest ends are bounded by respective a bounding metal portions of another metal layer deeper than the fuse-level metal layer.

12. The fuse of claim 8, wherein the first and second cavities extend to the depth below the fuse-level metal layer, wherein the first and second cavities have respective deepest ends nearest to the substrate, and wherein the deepest ends are bounded by the substrate.

13. A method of fabricating a fuse over a substrate of an integrated circuit, comprising:

forming a conductive trace in a fuse-level metal layer of the integrated circuit, wherein the fuse-level metal layer is disposed over a substrate of the integrated circuit, wherein the conductive trace comprises a fusible portion having a higher resistance than other portions of the conductive trace, and wherein the fusible portion comprises a longest dimension;

forming a dielectric structure over the fusible portion and beyond the fusible portion in a direction parallel to a major surface of the substrate; and forming a first cavity into the dielectric structure, the first cavity configured to capture debris from the fusible portion when the fusible portion is fused, wherein the first cavity is proximate to the fusible portion and separated from the fusible portion by a first separation wall, wherein the first cavity has a depth to at least a depth of the fuse-level metal layer with a deeper direction being in a direction toward the substrate, wherein the entire first cavity is disposed to a first side of the fusible portion in a direction parallel to a major surface of the substrate and perpendicular to the longest dimension of the fusible portion such that no part of the first cavity is over the fusible portion, wherein the first separation wall has a thickness selected to result in fracture, the fracture causing a fracture opening in the first separation wall and capture of debris from the fusible portion within the first cavity when the fusible portion is fused.

14. The method of claim 13, wherein the selected thickness of the first separation wall is within about +/− ten percent of 1.2 micrometers.

15. The method of claim 14, wherein the fusible portion has a width within about +/− ten percent of 1.0 micrometers.

16. The method of claim 13, wherein the first cavity extends to a depth at or below the fuse-level metal layer.

17. The method of claim 13, wherein the first cavity extends to the depth of the fuse-level metal layer, wherein the first cavity has a deepest end nearest to the substrate, and wherein the deepest end is bounded by a bounding metal portion of the fuse-level metal layer.

18. The method of claim 13, wherein the first cavity extends to a depth below the fuse-level metal layer, and wherein the first cavity has a deepest end nearest to the substrate, and wherein the deepest end is bounded by a bounding metal portion of another metal layer deeper than the fuse-level metal layer.

19. The method of claim 13, wherein the first cavity extends to a depth below the fuse-level metal layer, and wherein the first cavity has a deepest end nearest to the substrate, and wherein the deepest end is bounded by the substrate.

20. The method of claim 13, further comprising:

forming a second cavity into the dielectric structure, the second cavity configured to capture debris from the fusible portion when the fusible portion is fused, wherein the second cavity is proximate to the fusible portion and separated from the fusible portion by a second separation wall, wherein the second cavity has a depth to at least a depth of the fusible portion, wherein the entire second cavity is disposed to a second side of the fusible portion different than the first side in a direction parallel to the major surface of the substrate and perpendicular to the longest dimension of the fusible portion such that no part of the second cavity is over the fusible portion, wherein the first separation wall and the second separation wall have a thickness selected to result in fracture, the fracture causing a fracture opening in at least one of the first separation wall and the second separation wall and capture of debris from the fusible portion within at least one of the first cavity or the second cavity when the fusible portion is fused.

21. The method of claim 13, wherein the selected thickness of the first and second separation walls is within about +/− ten percent of 1.2 micrometers.

22. The method of claim 13, wherein the first and second cavities extend to the depth of the fuse-level metal layer, wherein the first and second cavities have respective deepest ends nearest to the substrate, and wherein the deepest ends are bounded by respective bounding metal portions of the fuse-level metal layer.

23. The method of claim 15, wherein the first and second cavities extend to the depth below the fuse-level metal layer, wherein the first and second cavities have respective deepest ends nearest to the substrate, and wherein the deepest ends are bounded by respective a bounding portions of another metal layer deeper than the fuse-level metal layer.

24. The method of claim 15, wherein the first and second cavities extend to the depth below the fuse-level metal layer, wherein the first and second cavities have respective deepest ends nearest to the substrate, and wherein the deepest ends are bounded by the substrate.

* * * * *

UNITED STATES PATENT AND TRADEMARK OFFICE

CERTIFICATE OF CORRECTION

PATENT NO. : 9,184,012 B2
APPLICATION NO. : 13/720098
DATED : November 10, 2015
INVENTOR(S) : Yigong Wang It is certified that error appears in the above-identified patent and that said Letters Patent is hereby corrected as shown below:

Specification

Column 1, line 28, delete "in and an" and replace with --in an--.

Column 3, line 11-12, delete "16 also a size," and replace with --16 can also have a size,--.

Column 3, line 24, delete "low-voltage," and replace with --low voltage,--.

Column 3, lines 29, delete "and in" and replace with --and a--.

Column 3, line 45, delete "in r" and replace with --in a--.

Column 4, line 5, delete "or metal" and replace with --or top metal--.

Column 4, line 30, delete "plurality steps," and replace with --plurality of steps,--.

Column 4, line 60, delete "of regions" and replace with --of the regions--.

Column 5, line 25, delete "of regions" and replace with --of the regions--.

Column 5, lines 27, delete "move" and replace with --moves--.

Column 5, line 31, delete "integrated ensues," and replace with --integrated circuit ensues,--.

Column 5, line 56, delete ", this not" and replace with --, this is not--.

Column 6, line 41, delete ", this not" and replace with --, this is not--.

Column 7, line 11, delete ", this not" and replace with --, this is not--.

Signed and Sealed this
Twenty-fourth Day of May, 2016

Michelle K. Lee

Michelle K. Lee
*Director of the United States Patent and Trademark Office*

Claims

Column 8, line 41, Claim 1 delete “respective a bounding” and replace with --respective bounding--.

Column 10, line 29, Claim 23 delete “respective a bounding” and replace with --respective bounding--.